United States Patent [19]

Figini

[11] 4,269,624

[45] May 26, 1981

[54] METHOD FOR THE PRODUCTION OF NON-EVAPORABLE TERNARY GETTERING ALLOYS

[75] Inventor: Alessandro Figini, Milan, Italy

[73] Assignee: SAES Getters S.p.A., Milan, Italy

[21] Appl. No.: 115,050

[22] Filed: Jan. 24, 1980

[30] Foreign Application Priority Data

Feb. 5, 1979 [IT] Italy ..... 19902 A/79

[51] Int. Cl.[3] ..... C22C 13/00; F17C 11/00

[52] U.S. Cl. ..... 75/177; 75/134 V; 75/135; 75/174

[58] Field of Search ..... 75/177, 135, 134 V, 75/174

[56] References Cited

U.S. PATENT DOCUMENTS

| | | | |
|---|---|---|---|
| 1,503,772 | 8/1924 | Smith | 75/177 |
| 3,194,655 | 7/1965 | Pels et al. | 75/135 |
| 3,367,771 | 2/1968 | Robertson et al. | 75/135 |
| 4,163,666 | 8/1979 | Shaltiel et al. | 75/177 |
| 4,164,420 | 8/1977 | Armand et al. | 75/175 R |

FOREIGN PATENT DOCUMENTS

| | | | |
|---|---|---|---|
| 1098217 | 1/1968 | United Kingdom . | |
| 1370208 | 10/1974 | United Kingdom | 75/177 |

*Primary Examiner*—L. Dewayne Rutledge
*Assistant Examiner*—Upendra Roy
*Attorney, Agent, or Firm*—David R. Murphy

[57] ABSTRACT

This invention relates to a method for the production of non-evaporable ternary gettering alloys of the type Zr-$M_1$-$M_2$ in which $M_1$ is a metal chosen from the group comprising vanadium and niobium, and in which $M_2$ is a metal chosen from the group comprising iron and nickel.

8 Claims, No Drawings

METHOD FOR THE PRODUCTION OF NON-EVAPORABLE TERNARY GETTERING ALLOYS

BACKGROUND OF THE INVENTION

The present invention relates to a method for the production of nonevaporable ternary gettering alloys.

Ternary gettering alloys are already known, for example from British Pat. No. 1,370,208 where specific reference is made to alloys based on zirconium Zr-Ti-Ni and to is usefulness in applications in which it is necessary to stoichiometrically sorb humidity or water vapour, as well as other gases, without liberating hydrogen.

In a recent patent application by the present applicant there is described the alloy Zr-V-Fe which has been shown to be particularly useful and advantageous not only for the sorption of water and water vapour without release of hydrogen, but also in many other applications, for example when it is necessary to activate the getter alloy at relatively low temperatures.

In United Kingdom Pat. No. 1,370,558 there are described methods for the production of the ternary alloys Zr-Ti-Ni.

One of these methods consists in making holes in lumps of one component, in filling these holes with pieces of the other components and then performing a series of melting processes. The alloy thus obtained is then rolled into thin sheets, cut into small pieces and then again melted.

According to another method the alloy is produced in a bimetallic sheet into which is then diffused the third component.

Yet another method involves mixing the three components together and applying high pressures and temperatures up to 1800° C. or more.

All these methods for the production of ternary alloys based on zirconium are therefore complex, require much time and are therefore costly and uneconomic.

The object of the present invention is therefore that of providing a more simple and economic method for the production of ternary non-evaporable getter alloys based on zirconium.

Another object of the invention is that of providing a method for the production of a non-evaporable ternary getter alloy of the type Zr-$M_1$-$M_2$, in which $M_1$ is a metal chosen from the group comprising vanadium and niobium, and in which $M_2$ is a metal chosen from the group comprising iron and nickel.

SUMMARY OF THE INVENTION

The above and other objects will be obtained with the method of the present invention, which method comprises the steps of mixing zirconium and an alloy $M_1$-$M_2$ in air at atmospheric pressure and at room temperature and successively melting the mixture in vacuum at a pressure of less than $10^{-2}$ torr and preferably less than $10^{-3}$ torr or in an inert atmosphere at less than atmospheric pressure and preferably at about a pressure of 500 torr, allowing the ternary alloy so obtained to cool to room temperature and then grinding the alloy to a powder whose particle size is less than 500$\mu$.

These alloys, even with a fine particle size are not pyrophoric. Fortunately alloys $M_1$-$M_2$ are readily available on the market at a cost very much lower than the cost of pure metal $M_1$, as these alloys are used in the production of special alloys and steels. Furthermore metals $M_2$ are in fact natural impurities of metals $M_1$. Therefore the production of metals $M_1$ still "contaminated" with metals $M_2$ can take place at a relatively low cost because the materials do not have to be subjected to additional purification processes.

DESCRIPTION OF THE INVENTION

While both the element vanadium and the element niobium are both very expensive and not readily available in a pure form they are easily, and at a low cost, available in the form of alloys with iron or nickel.

Furthermore, it is noted that vanadium has a melting point of about 1900° C. and niobium has a melting point greater than 2450° C., while the melting point of their alloys with iron or nickel in mixture with zirconium is substantially lower.

So for example if zirconium sponge is mixed with an alloy $M_1$-$M_2$ in air at atmospheric pressure and at room temperature it has been found that the mixture melts under vacuum or an inert atmosphere at a temperature less than about 1400° C. The preparation of ternary alloys Zr-$M_1$-$M_2$ does not therefore require excessively high temperatures. In order to prevent the reaction of the componenents with atmospheric gases during the melting process it is performed in an inert atmosphere at about a pressure of 500 torr or under a vacuum preferably less than $10^{-3}$ torr.

In the method according to the present invention it is theoretically possible to use any alloy $M_1$-$M_2$, but it has been found that if the content of $M_1$ is too high the alloy is expensive due to the refining processes involved while if the content of $M_1$ is too low the ternary alloy does not have the desired gas sorption properties.

It has been established that the weight percent of the element $M_1$ in the alloy $M_1$-$M_2$ should preferably be from 50–90%.

For the alloys V-Fe, the weight percent of vanadium is preferably from 75–85%, while for the alloys V-Ni, Nb-Fe and Nb-Ni the weight percent of metal $M_1$ is preferably from 65–75%.

Also the weight ratio between Zr and the alloy $M_1$-$M_2$ can vary between wide limits, but if the content of Zr is too high or too low it has been found that the ternary alloy, is used for sorption of water or water vapour does not have the desired sorption properties for oxygen and hydrogen but liberates hydrogen. Furthermore in this case the ternary alloy is relatively plastic and there are difficulties in transforming it into a fine powder.

It has been found that the weight ratio of Zr to the alloy $M_1$-$M_2$ should generally be from 1:2 to 3:1, and preferably from 1:1 to 2.5:1.

The zirconium can be used in any suitable form such as metal wire, lumps, chips, or also in sponge form.

When being used as a getter material the alloy is preferably in a powder form having a particle size from 1$\mu$ to 500$\mu$, and preferably from 25$\mu$ to 125$\mu$.

The invention is further illustrated by the following examples in which all parts and percentages are by weight unless otherwide indicated. These non-limiting examples are illustrative of certain embodiments designed to teach those skilled in the art how to practice the invention and to represent the best mode contemplated for carrying out the invention.

EXAMPLE 1

30 grams of Zr sponge of commercial purity grade, obtained from Ugine-Kuhlman (France) where broken into small lumps and mixed in air at atmospheric pressure and at room temperature with 20 grams of lumps of a V-Fe alloy containing (nominal) 82% V obtained from Murex, United Kingdom. The mixture was placed in a cold copper crucible vacuum furnace as described by A. Barosi in the paper entitled "Gettering Activities of some Single Phases Present in the Zr-Al Alloy System", Residual Gases in Electron Tubes, Ed. T. A. Giorgi and P. della Porta, Academic Press, 1972, p. 221–235. The vacuum furnace was evacuated to about $10^{-5}$ torr by means of a turbomolecular pump and the HF induction heating generator was switched on.

Within a few minutes a temperature of approximately 1250° C. was reached and the mixture became a molten mass. The generator was switched off and the alloy allowed to cool to room temperature. The alloy ingot was then broken into small lumps and remelted several times to ensure even and uniform alloy formation. It should be realized that in an industrial manufacturing process a single slightly prolonged heating stage would be used as being sufficient to ensure uniform alloy formation. The multiple heating steps in the present examples were performed only for reasons of scientific thoroughness. After the final cooling step the ingot was found to weigh 49.5 grams. Part of the ingot was ground in a ball mill, under argon, until the particle size was less than 125μ.

The alloy has an overall composition of: 60% Zr-32.8% V-7.2% Fe.

EXAMPLE 2

The procedure of Example 1 was repeated except that the mixture comprised 23.6 grams of Zr sponge and 26.4 grams of the 82% V-Fe alloy.

The ternary alloy produced has an overall composition of:

47.2% Zr-43.3 V-9.5% Fe

EXAMPLE 3

The procedure of Example 1 was repeated except that the mixture comprised 35 grams of Zr sponge and 15 grams of the 82% V-Fe alloy. In addition, during the melting process a pressure of 500 torr argon was present in the furnace.

The alloy had an overall composition of:

70% Zr-24.6% V-5.4% Fe

All three alloys when heated to temperatures between 200°–350° C. in vacuum were found to sorb water without the release of hydrogen. Also after heating to 400 for 2 minutes in vacuum they were found to sorb other gases at 25° C. such as $H_2$ and CO.

EXAMPLE 4

The procedure of Example 1 was repeated except that the mixture comprised 35 grams of zirconium lumps and 15 grams of an alloy of Nb-Ni supplied by Murex with a nominal Nb content of 65–70%. The melting was performed under a 400 torr pressure of argon and took place at less than 1300° C. The weight of the ingot produced was 49.4 grams having a composition:

70% Zr-20.25% Nb-9.75% Ni

EXAMPLE 5

The procedure of Example 1 was repeated except that the mixture comprised 34.25 grams of zirconium lumps and 15.75 grams of an alloy of V-Ni supplied by Murex with a composition of 68% V. The melting was performed under vacuum and took place at about 1200° C. The weight of the ingot produced was 49.75 grams having a composition:

68.5% Zr-21.4% V-10.1% Ni

From the above described examples it is clear that ternary alloys of the present invention can easily be produced starting from commercially available binary alloys $M_1$-$M_2$ without requiring the use of high temperatures or complicated techniques and so they are relatively economic.

These alloys can be used with advantage for the sorption of water and water vaour without the release of hydrogen at relatively low temperatures, that is less than 350° C., and particularly in the range fromm 200° C. to 350° C. The same ternary alloys are also able to sorb other gases, such as $H_2$, CO, $CO_2$ etc. Regarding the last point it has been found that after a thermal treatment for activation at 400° C. for about 2 minutes the alloys obtained by the method of the invention are able to sorb for example $H_2$ and CO at room temperature (25° C.).

Although the invention has been described in detail with reference to certain preferred embodiments variations and modifications can be performed within the scope and spirit of the invention as described and as defined in the following claims.

I claim:

1. A method for the production of non-evaporable ternary gettering alloys of the type Zr-$M_1$-$M_2$ in which $M_1$ is a metal chosen from the group comprising vanadium and niobium and in which $M_2$ is a metal chosen from the group comprising iron and nickel; said method comprising in sequence the steps of:

I. mixing zirconium and an alloy $M_1$-$M_2$ in air at atmospheric pressure and at room temperature to form a mixture; and then II. melting the mixture under vacuum at a pressure of less than $10^{-2}$ torr or in an inert atmosphere at less than atmospheric pressure to form a ternary alloy; and then III. cooling the ternary alloy to room temperature; and then IV. grinding the ternary alloy to obtain a powder having a particle size less than 500μ.

2. Method according to claim 1 characterized by the fact that the alloy $M_1$-$M_2$ has a weight percent of $M_1$ between 50% and 90%.

3. Method according to claim 2 characterized by the fact that the alloy is V-Fe in which the weight percent of V is between 75% and 85%.

4. Method according to claim 2 characterized by the fact that the alloy is V-Ni or Nb-$M_2$ in which the percent of V or of Nb is between 65% and 75%.

5. Method according to claim 1 characterized by the fact that Zr is mixed with the alloy $M_1$-$M_2$ in the weight ratio from 1:2 to 3:1.

6. Method according to claim 1 characterized by the fact that Zr sponge is mixed in the weight ratio from 1:1 to 2.5:1 with an alloy of V-Fe having a nominal weight content of V of 82%, that the alloy is heated in vacuum of greater than $10^{-3}$ torr at a temperature less than 1400° C. that the alloy so obtained is allowed to cool to room temperature and that this cooled alloy is ground to a powder having a particle size less than 125μ.

7. Method according to claim 1 characterized by the fact that Zr is mixed with the alloy $M_1$-$M_2$ in the weight ratio of from 1.1 to 2.5:1.

8. A method for the production of non-evaporable ternary gettering alloys of the type Zr-V-Fe; said method comprising in sequence the steps of:

I. mixing in air, at atmospheric pressure, at room temperature a Zr-sponge with a V-Fe alloy in the weight ratio of from 1:1 to 2.5:1; wherein the V-Fe alloy has a nominal weight content of V of 82% to form a mixture; and then II. melting the mixture under vacuum at a pressure less than $10^{-3}$ torr at a temperature between 1250° and 1400° C. to form a ternary alloy; and then III. cooling the ternary alloy to room temperature; and then IV. grinding the ternary alloy to obtain a powder having a particle size less than 125μ.

* * * * *